US006203300B1

(12) United States Patent
Williams et al.

(10) Patent No.: US 6,203,300 B1
(45) Date of Patent: Mar. 20, 2001

(54) SCROLL COMPRESSOR WITH STRUCTURE FOR PREVENTING REVERSE ROTATION

(76) Inventors: John R. Williams, 7 Timber Ridge Cir.; John M. Hunnicutt, 23 Angela La., both of Arkadelphia, AR (US) 71923; Joe T. Hill, 149 Heritage Dr., Bristol, VA (US) 24201

( * ) Notice: Subject to any disclaimer, the term of this patent is extended or adjusted under 35 U.S.C. 154(b) by 0 days.

(21) Appl. No.: 09/037,370

(22) Filed: Mar. 10, 1998

(51) Int. Cl.[7] ..... F04C 18/00
(52) U.S. Cl. ..... 418/55.5; 418/57
(58) Field of Search ..... 418/55.5, 57

(56) References Cited

U.S. PATENT DOCUMENTS 5,165,879 * 11/1992 Kondo et al. ..... 418/55.5
5,174,738 * 12/1992 Baumann ..... 418/55.5
5,199,862 * 4/1993 Kondo et al. ..... 418/55.5
5,201,645 * 4/1993 Steele ..... 418/55.5
5,433,589 * 7/1995 Wada et al. ..... 418/55.5
5,452,995 * 9/1995 Izumi et al. ..... 418/55.5
5,496,157 * 3/1996 Shoulders ..... 418/55.5
5,496,158 * 3/1996 Barito et al. ..... 418/55.5
5,582,513 * 12/1996 Shigeoka et al. ..... 418/55.5

FOREIGN PATENT DOCUMENTS 5-248371 * 9/1993 (JP) ..... 418/55.5

OTHER PUBLICATIONS

PCT Search Report.

* cited by examiner

*Primary Examiner*—Thomas Denion
*Assistant Examiner*—Thai-Ba Trieu

(57) ABSTRACT

A scroll compressor includes structure between an eccentric and a slider block that separates the scroll wraps when the orbiting scroll is driven in a reverse direction by entrapped fluid. In the prior art, entrapped fluid sometimes has driven the orbiting scroll in a reverse direction at shutdown, resulting in undesirable noise. The present invention stops movement of the orbiting scroll relative to the fixed scroll during reverse rotation by opening the fluid chambers dissipating that pressure.

15 Claims, 2 Drawing Sheets

SCROLL COMPRESSOR WITH STRUCTURE FOR PREVENTING REVERSE ROTATION

BACKGROUND OF THE INVENTION

This invention relates to a unique slider block for use in a scroll compressor to prevent reverse rotation at shutdown.

Scroll compressors generally include two scroll members each having a base with a generally spiral wrap extending from the base. The two wraps interfit and move into contact to define a plurality of compression chambers. One of the wraps is moved through an orbital movement relative to the other. During the orbital movement, the wraps of the orbiting scroll move along the wraps of the fixed scroll and the compression chambers are compressed towards a discharge point. Scroll compressors are becoming widely utilized as they efficiently compress refrigerant. However, there are many challenges in the design of a scroll compressor.

One challenge is to eliminate noise that occurs at shutdown of the scroll compressor. At shut down there will typically be a quantity of compressed fluid between the orbiting and fixed scroll wraps. Since the motor is no longer driving the orbiting scroll, the compressed fluid may sometimes to drive the orbiting scroll in a reverse rotational direction relative to the fixed scroll member. This reverse rotation is undesirable and causes noise at shutdown. This noise may be interpreted by a consumer as a design or unit flaw. Thus, it is desirable to eliminate reverse rotation at shutdown.

SUMMARY OF THE INVENTION

In the disclosed embodiment of the present invention, a slider block is placed between an eccentric and the orbiting scroll member. The slider block is effective to change the offset in the rotational axis between the eccentric and the orbiting scroll. This allows change in the orbit radius which in turn allows the orbiting scroll to move into and maintain engagement with the fixed scroll.

During rotation in a forward direction, forces cause the slider block to move in a first direction which allows the orbiting scroll to move into engagement with the fixed scroll. Once the orbiting scroll is in sealing engagement with the fixed scroll, the compression chambers are defined and compression occurs with further forward movement.

At shutdown, as the orbiting scroll slows and begins to move in a reverse direction due to the storage of compressed fluid, the slider block moves in a second direction. Interfitting structure between the eccentric and the slider block contact to provide a stop. This interfitting structure blocks further relative movement of the eccentric and slider block. The slider block then prevents any further movement of orbiting scroll axis relative to fixed scroll axis, and such that the scroll wraps are held out of contact with each other. There are thus gaps between the wraps of the orbiting and fixed scrolls and the discharge pressure is dissipated at shutdown.

In the preferred embodiment of this invention, the slider block and eccentric are designed such that the predominant force moving the slider block in the first direction to its forward position is centrifugal force. The centrifugal force is relatively great when compared to the frictional forces encountered by the slider block between both the orbiting scroll and eccentric, and overcomes these frictional forces during normal operation. As the scroll slows from full forward speed to zero, and then the entrapped gas driven reverses at low speed, centrifugal force drops. During entrapped gas caused reverse rotation, the rotational speed of the orbiting scroll is much less than encountered during powered rotation. Thus, the centrifugal force component is much smaller. The frictional forces may overcome the centrifugal force, and move the slider block to the stop position, as described above.

In a preferred embodiment of this invention, the interfitting stop structure incorporates a relatively flat surface formed in an inner bore in the slider block. The eccentric is formed with a mating surface which selectively contacts the flat surface on the slider block to define the stop position. The eccentric is preferably formed with an arc surface which selectively contacts the slider block stop surface. Thus, there is line contact between the eccentric and the slider block at the stop position.

In a preferred embodiment, the stop structure on the slider block and the eccentric is formed over a small portion of the axial length of the members. Beyond this small portion, the members have generally cylindrical shapes, and function as in the prior art.

With the present invention, when the scroll compressor is driven in a forward direction, the slider block is driven by centrifugal force such that its stop portion is maintained out of engagement with the mating stop portion on the eccentric. The orbiting scroll wrap is allowed to move into contact with the fixed scroll wrap and compression can occur. However, at shutdown, should the compressed gas begin to drive the orbiting scroll in a reverse direction relative to the fixed scroll, the slider block will roll to the stop position due to the relatively great frictional forces. The stop surface on the eccentric now abuts the stop surface on the slider block. The orbiting scroll is pulled away from the fixed scroll, creating a gap between the respective wraps. The previously compressed gas is thus dissipated and reverse rotation does not occur.

These and other features of the present invention can be best understood from the following specification and drawings, the following of which is a brief description.

DETAILED DESCRIPTION OF A PREFERRED EMBODIMENT

Figure 1:
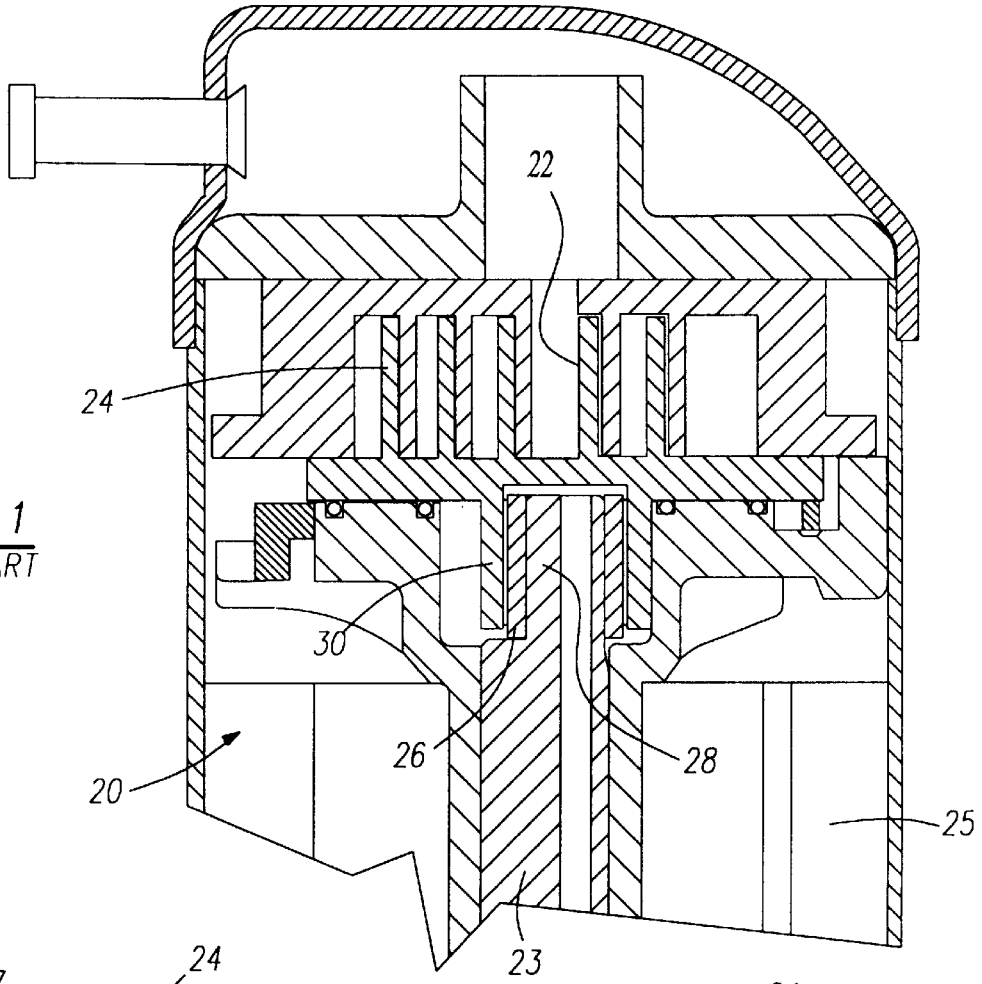
Fig-1 PRIOR ART
FIG. 1 is a cross-sectional view showing a known scroll compressor.

FIG. 1 shows a scroll compressor 20 incorporating an orbiting scroll having a wrap 22 and a fixed non-orbiting scroll shown here as a scroll having a wrap 24. As known, the orbiting scroll is driven by a crankshaft 23 through an electric motor 25.

Figure 2:
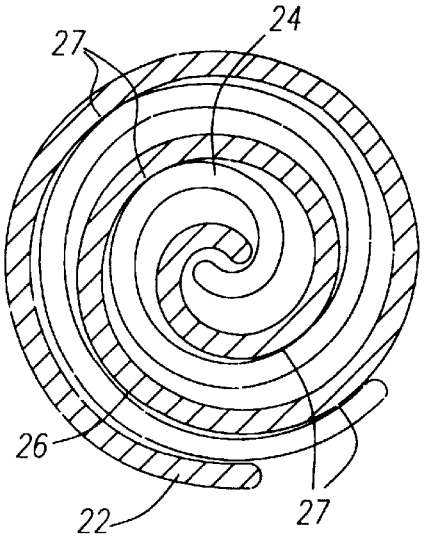
Fig-2 PRIOR ART
FIG. 2 shows a known scroll compressor with the wraps in contact with each other.

Scroll compressors operate by having the orbiting scroll wrap 22 move into contact with the fixed scroll wrap at several points 27 as shown in FIG. 2. Compression chambers are defined between the scroll wraps, and compression of the entrapped fluid occurs during relative orbiting motion.

Figure 3:
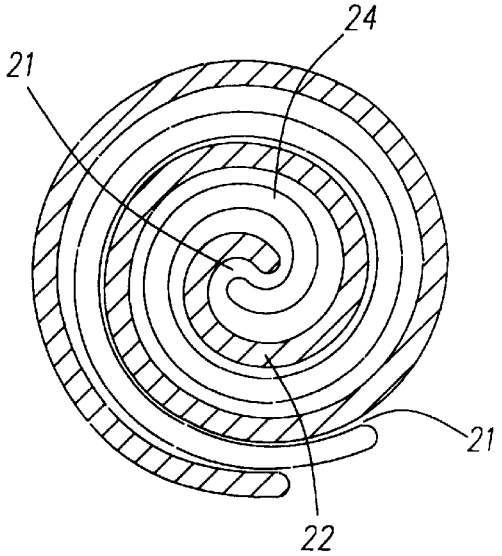
Fig-3 PRIOR ART
FIG. 3 shows a known scroll compressor with the wraps not in contact with each other.

As shown in FIG. 3, the wraps are out of contact such that gaps 21 exist between the wraps. With the wraps in this position, refrigerant is not trapped, and can escape through the gaps. This equalizes the force, removing the reverse driving force.

Figure 4A:
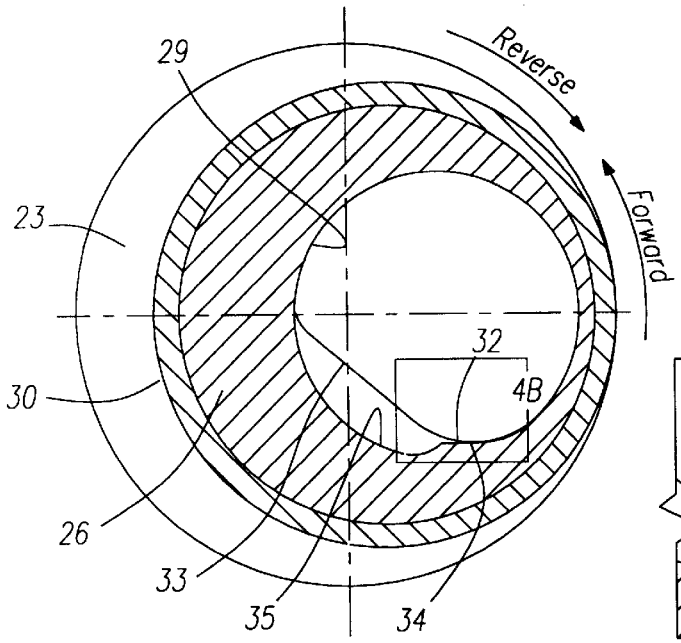
FIG. 4A is a cross-sectional view through a portion of the inventive scroll compressor.
Figure 4B:
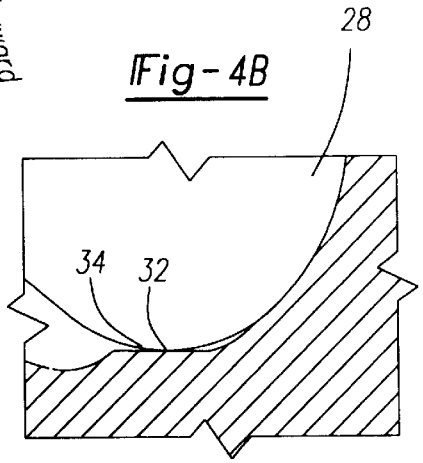
FIG. 4B is a detail of FIG. 4A.
Figure 5:
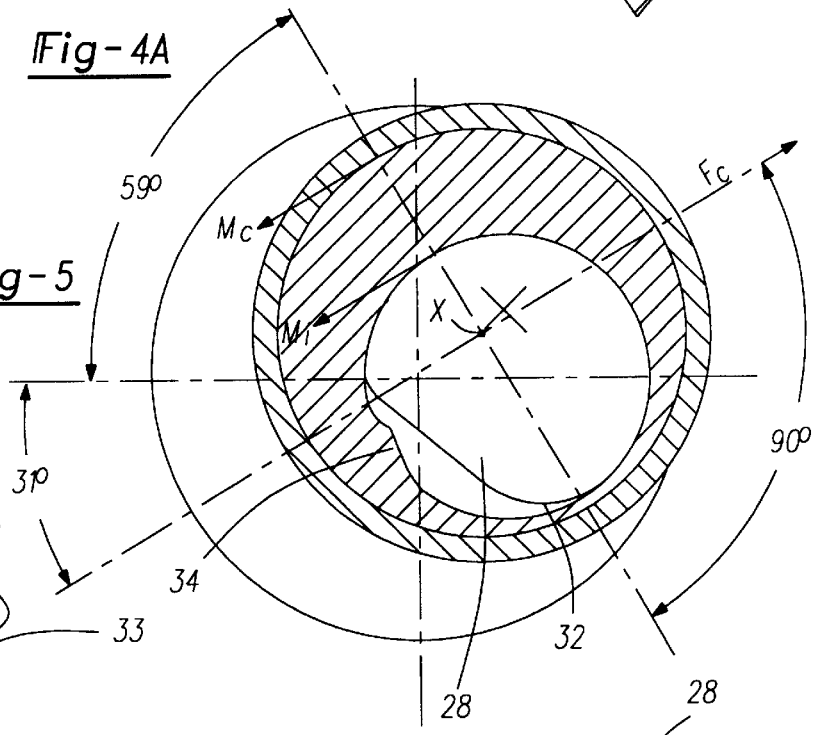
FIG. 5 shows the scroll compressor in a forward rotational direction.
Figure 6:
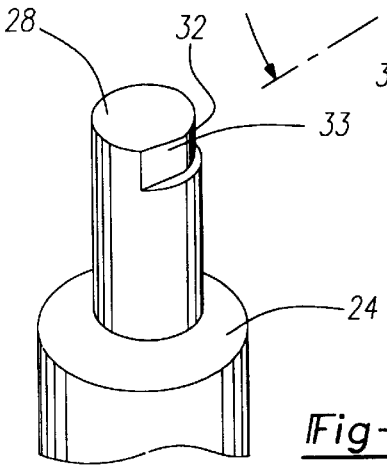
FIG. 6 shows a detail of the eccentric portion of the crank shaft of the present invention.

FIGS. 4–6 show an embodiment of an eccentric and slider block for allowing the compressor to move to the FIG. 2 position when rotated in a forward direction, but maintaining the wraps in the FIG. 3 position should reverse rotation occur at shutdown of the compressor. Now the direction of forward and reverse rotation are shown in FIG. 4A. The embodiment shown in FIGS. 4–6 would also allow the scroll to move to the position shown in FIG. 2 upon powered reverse rotation. The use of a powered reverse rotation has some application in certain techniques utilized by scroll compressor designers. Thus, it may be desirable to allow the compressor to be in the FIG. 2 position should the reverse rotation occur by a powered drive.

FIG. 4A shows the slider block 26 received within the rear bore 30 of the orbiting scroll. The eccentric 28 is positioned within a bore 29 in the slider block 26. The eccentric 28 has a stop surface 32 at one end along with a flat portion 33. A stop surface 34 within bore 29 is adjacent a clearance groove 35 in the slider block 36. Surface 34 abuts surface 32, and further relative clockwise movement between the eccentric and the slider block cannot occur.

At shutdown, as forward speed drops and then reverse rotation begins, the slider block actually pulls the orbiting scroll away from the fixed scroll as it moves to its FIG. 4A position. The slider block is in this position at shutdown.

The slider block functions in this application to allow the orbiting scroll to adjust relative to the fixed scroll such that there will be contact between the sides of the wraps. Essentially, the slider block allows adjustment of the orbit radius of the orbiting scroll such that the orbiting scroll can move into contact with the fixed scroll and properly define the compression chambers. The present invention either allows this adjustment or prevents this adjustment depending on the rotational direction, and speed.

As can be seen in FIG. 4B, surface 32 is formed along an arc such that there is line contact between surfaces 32 and 34. The line contact allows the two surfaces to adjust for any manufacturing tolerances and quickly achieve a stop position.

In FIG. 5, the slider block is shown in a position where it has pivoted clockwise from the position shown in FIG. 4A to a position wherein the surface 34 is not in contact with the surface 32. This is the normal operational position of the members when the orbiting scroll is being driven in the forward direction.

As shown in FIG. 5, there are essentially three forces operating on the slider block to cause the slider block to pivot about its pivot axis X. There is a moment $m_0$ from a frictional force between the slider block and the orbiting scroll. There is also a moment m i from the frictional forces between the eccentric and the slider block. However, during this normal operation, the predominant force on the slider block is a centrifugal force $F_c$ from the orbiting scroll and slider blocks. This centrifugal force causes the slider block to rotate clockwise about the point X. The stop surface 34 is thus out of contact with the stop surface 32. With movement from the position shown in FIG. 4A to the position shown in FIG. 5, the central axis of orbiting scroll wrap 22 is allowed to move relative to the fixed scroll wrap 24. This allows wrap 22 to move into contact with the wrap 24. As shown in FIG. 5, further relative movement between the slider block and eccentric can occur. That is, the slider block and eccentric are designed to allow more adjustment then should be necessary. Thus, the slider block allows adjustment of the position of the wraps 22 and 24 such that a proper contact does occur. The scroll compressor can now compress the fluid as in the prior art.

There is also a substantial tangential gas force from the compressed gas. This force generally passes through centerpoints x-y, and does not effect the slider block position or the above forces. In some scroll compressors, the tangential gas force may be at an off-center point. However, a scroll designer can easily design the slider block to accommodate this force and still work as disclosed.

At shutdown, there have sometimes been occurrences where a previously compressed gas remains trapped between the scroll wraps. The compressed gas may attempt to drive the orbiting scroll in a reverse direction relative to the fixed scroll. When the scroll is driven in a reverse direction by trapped fluid forces, the centrifugal force component $F_c$ is no longer greater than the frictional forces $m_0$ and $m_i$. Instead, the slider block is caused to roll counterclockwise relative to the eccentric to the position shown in FIG. 4A. At this position, further movement of the orbiting scroll relative to the fixed scroll is prevented. The orbiting scroll is thus maintained out of contact with the fixed scroll, and the compression chambers are not closed. Trapped fluid will not drive the orbiting scroll any further, but instead will be quickly dissipated.

Figure 7:
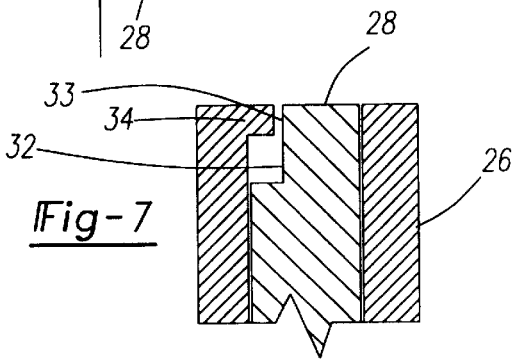
FIG. 7 shows the eccentric and slider block.

As shown in FIG. 6, the stop surface 32 and the flat 33 are only formed over a small portion of the axial length of the eccentric 28. Although omitted for illustration simplicity, the pin could have a barrel-shaped cross-section, as is known. As can be seen in FIG. 7, the same is true for the surfaces 34 and 35 found within the slider block 29.

The structures shown in FIGS. 4–6 relies on the difference between the centrifugal force at a normal operational speed, and the greatly reduced speeds that occur during gas-induced reverse rotation to provide a stop. In the event that a powered reverse rotation occurs, the centrifugal force component $F_c$ will again be much greater than the moments $m_0$ and $m_i$, and the slider block will move to the FIG. 5 position. Thus, the structures shown in FIGS. 4–6 is not operable to dissipate the pressure when a powered reverse rotation occurs. This is sometimes beneficial as there are occasions where it is desirable to have a powered reverse rotation. The stop arrangement thus functions upon rotation in the reverse rotation below certain speeds.

Of course, this invention would extend to arrangements wherein the stop position would occur even during powered reverse rotation. It may be desirable in the design of many scroll compressors to not allow compression in the event of powered reverse rotation.

A worker of ordinary skill in the art would recognize that certain modifications would come within the scope of this invention. Thus, the following claims should be studied to determine the true scope and content of this invention.

What is claimed is:

1. A scroll compressor comprising:

a non-orbiting scroll having a base and a scroll wrap extending from said base;

an orbiting scroll having a base and a scroll wrap extending from said base in a direction toward said base of said non-orbiting scroll, said wraps of said non-orbiting and orbiting scrolls interfitting to define compression chambers;

a crank shaft having an eccentric for driving said orbiting scroll;

a slider block positioned between said eccentric and said orbiting scroll, said slider block allowing said orbiting scroll to change an orbit radius and allow said orbiting scroll wrap to move into contact with said non-orbiting scroll wrap; and structure on said slider block and said eccentric to allow said orbiting scroll to move into contact with said non-orbiting scroll when said crank shaft is rotated in a first direction, but to prevent said orbiting scroll from moving into contact with said non-orbiting scroll if said crank shaft is rotated in a second direction opposed to said first direction under at least some operational speeds, said structure including an arc interface between said slider block and said eccentric which is in contact when said orbiting scroll is rotated in said first direction.

2. A scroll compressor as recited in claim 1, wherein said structure pulls said orbiting scroll out of engagement with said non-orbiting scroll when rotation switches from said first direction to said second direction.

3. A scroll compressor as recited in claim 1, wherein said structure prevents movement of said orbiting scroll only at relatively low speeds in said second direction, but allows movement at higher speeds in said second direction.

4. A scroll compressor as recited in claim 1, wherein said structure between said slider block and said eccentric include a flat surface formed on one of said slider block and said eccentric.

5. A scroll compressor as recited in claim 4, wherein an arc surface is formed on the other of said slider block and said eccentric such that there is line contact between said arc surface and said flat surface.

6. A scroll compressor as recited in claim 5, wherein said arc surface is formed on said eccentric and said flat surface is formed within a bore in said slider block.

7. A scroll compressor as recited in claim 5, wherein a cutaway portion is formed circumferentially adjacent to said structure on said eccentric surface to allow said eccentric and said slider block to move relative to each other as rotation reverses.

8. A scroll compressor as recited in claim 7, wherein said structure is formed over only a portion of the axial length of said eccentric and said slider block.

9. A scroll compressor comprising:

a non-orbiting scroll having a base and a scroll wrap extending from said base;

an orbiting scroll having a base and a scroll wrap extending from said base in a direction toward said base of said non-orbiting scroll, said wraps of said non-orbiting and orbiting scrolls interfitting to define compression chambers;

a crank shaft having an eccentric for driving said orbiting scroll;

a slider block positioned between said eccentric and said orbiting scroll, said slider block allowing said orbiting scroll to change an orbit radius and allow said orbiting scroll wrap to move into contact with said non-orbiting scroll wrap; and a stop surface formed within a bore in said slider block, there being a mating stop surface formed on an outer periphery of said eccentric, the stop surfaces on said eccentric and said slider block being out of contact with each other when said orbiting scroll is driven in a first direction, and said stop surfaces moving into contact with each other when said orbiting scroll is rotating in a second direction and at low speeds, said structure including an arc interface between said slider block and said eccentric which is in contact when said orbiting scroll is rotated in said first direction.

10. A scroll compressor as recited in claim 9, wherein said stop surface on said slider block includes a flat surface formed adjacent to a cutaway surface in said inner bore.

11. A scroll compressor as recited in claim 10, wherein an arc is formed on said outer periphery of said eccentric as said stop surface.

12. A scroll compressor as recited in claim 9, wherein said stop surfaces are formed over only a portion of the axial length of said eccentric and said slider block.

13. A scroll compressor comprising:

a non-orbiting scroll having a base and a scroll wrap extending from said base;

an orbiting scroll having a base and a scroll wrap extending from said base in a direction toward said base of said non-orbiting scroll, said wraps of said non-orbiting and orbiting scrolls interfitting to define compression chambers;

a crank shaft having an eccentric for driving said orbiting scroll;

a slider block positioned between said eccentric and said orbiting scroll, said slider block allowing said orbiting scroll to change an orbit radius and allow said orbiting scroll wrap to move into contact with said non-orbiting scroll wrap; and structure on said slider block and said eccentric to allow said orbiting scroll to move into contact with said non-orbiting scroll when said crank shaft is rotated in a first direction, but to prevent said orbiting scroll from moving into contact with said non-orbiting scroll if said crank shaft is rotated in a second direction opposed to said first direction under at least some operational speeds, said structure between said slider block and said eccentric including a flat surface formed on one of said slider block and said eccentric and an arc surface formed on the other of said slider block and said eccentric such that there is line contact between said arc surface and said flat surface.

14. A scroll compressor comprising:

a non-orbiting scroll having a base and a scroll wrap extending from said base;

an orbiting scroll having a base and a scroll wrap extending from said base in a direction toward said base of said non-orbiting scroll, said wraps of said non-orbiting and orbiting scrolls inter fitting to define compression chambers;

a crank shaft having an eccentric for driving said orbiting scroll;

a slider block positioned between said eccentric and said orbiting scroll, said slider block allowing said orbiting scroll to change an orbit radius and allow said orbiting scroll wrap to move into contact with said non-orbiting scroll wrap; and a stop surface formed within a bore in said slider block, there being a mating stop surface formed on an outer periphery of said eccentric, the stop surfaces on said eccentric and said slider block being out of contact with each other when said orbiting scroll is driven in a first direction, and said stop surfaces moving into contact with each other when said orbiting scroll is rotating in a second direction and at low speeds, said stop surface on said slider block including a flat surface formed adjacent to a cut away surface and said inner bore, and an arc formed on said outer periphery of said eccentric as said stop surface.

15. A scroll compressor comprising:

a fixed scroll having a base and a scroll wrap extending from said base;

an orbiting scroll having a base and a scroll wrap extending from said base in a direction toward said base of said fixed scroll, said wraps of said fixed and orbiting scrolls interfitting to define compression chambers;

a crank shaft having an eccentric for driving said orbiting scroll;

a slider block positioned between said eccentric and said orbiting scroll, said slider block allowing said orbiting scroll to change an orbit radius and allow said orbiting scroll wrap to move into contact with said fixed scroll wrap; and a stop surface formed within a bore in said slider block, there being a mating stop surface formed on an outer periphery of said eccentric, the stop surfaces on said eccentric and said slider block being out of contact with each other when said orbiting scroll is driven in a first direction, and said stop surfaces moving into contact with each other when said orbiting scroll is rotating in a second direction and at low speeds, said stop surfaces formed only over a portion of an axial length of said eccentric and said slider block.

* * * * *